US009247789B2

(12) United States Patent
Anderson et al.

(10) Patent No.: US 9,247,789 B2
(45) Date of Patent: Feb. 2, 2016

(54) BUCKLE ASSEMBLY

(75) Inventors: Jeffrey D. Anderson, Hampshire, IL (US); Christopher A. J. Iannello, Rolling Meadows, IL (US); Martin J. Nilsen, Hampshire, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 156 days.

(21) Appl. No.: 14/119,718

(22) PCT Filed: May 25, 2012

(86) PCT No.: PCT/US2012/039597

§ 371 (c)(1),
(2), (4) Date: Nov. 22, 2013

(87) PCT Pub. No.: WO2012/162615

PCT Pub. Date: Nov. 29, 2012

(65) Prior Publication Data

US 2014/0096348 A1 Apr. 10, 2014

Related U.S. Application Data

(60) Provisional application No. 61/490,142, filed on May 26, 2011.

(51) Int. Cl.
*A44B 11/25* (2006.01)

(52) U.S. Cl.
CPC ..... *A44B 11/2592* (2013.01); *A44B 11/2526* (2013.01); *A44B 11/2561* (2013.01); *Y10T 24/45623* (2015.01)

(58) Field of Classification Search
CPC ..... A44B 11/25; A44B 11/2526; A44B 11/2511; A44B 11/2588; Y10T 24/45696; Y10T 24/45691
USPC ..... 24/633, 170, 191, 193, 638, 646, 648, 24/650
See application file for complete search history.

(56) References Cited

U.S. PATENT DOCUMENTS 2,869,200 A * 1/1959 Phillips ..... A44B 11/2526 24/170
2,904,866 A * 9/1959 Carter ..... A44B 11/2526 24/170

(Continued)

FOREIGN PATENT DOCUMENTS

DE 8906264 U1 10/1989

OTHER PUBLICATIONS

Corresponding International Application No. PCT/US2012/039597 Search Report and Written Opinion dated Dec. 20, 2012.

*Primary Examiner* — Robert J Sandy
*Assistant Examiner* — Rowland Do
(74) *Attorney, Agent, or Firm* — Joseph M. Butscher; The Small Patent Law Group LLC

(57) ABSTRACT

A buckle assembly (10) includes a frame (12) having a base (66) connected to opposed side walls (68). The frame (12) has a latch chamber (70) between the base (66) and the opposed side walls (68). The buckle assembly (10) also includes a lever (14) pivotally secured with in the latch chamber (70) between the opposed side walls (68), and a latch (16) configured to be secured in the latch chamber (70) by the lever (14). The latch (16) may include a frame-engaging member (30) having an ogived leading end (36). The ogived leading end (36) is configured to self-align the latch (16) within the latch chamber (70) when the latch (16) is mated into the latch chamber (70).

17 Claims, 5 Drawing Sheets

(56) References Cited

U.S. PATENT DOCUMENTS

| | | | | | |
|---|---|---|---|---|---|
| 2,933,795 | A | | 4/1960 | Meeker | |
| 2,965,942 | A | * | 12/1960 | Carter | A44B 11/2526 24/170 |
| 3,020,612 | A | * | 2/1962 | Meeker | A44B 11/14 24/170 |
| 3,165,806 | A | | 1/1965 | Lehman | |
| 3,182,372 | A | * | 5/1965 | Darrell | 24/644 |
| 3,228,082 | A | | 1/1966 | Skerry | |
| 3,255,502 | A | * | 6/1966 | Hollins | A44B 11/2526 24/191 |
| 3,343,229 | A | * | 9/1967 | Tanaka | A44B 11/2526 24/323 |
| 3,393,433 | A | * | 7/1968 | Barcus | 24/646 |
| 3,576,056 | A | * | 4/1971 | Barcus | A44B 11/2526 24/638 |
| 3,760,464 | A | * | 9/1973 | Higuchi | A44B 11/2526 24/196 |
| 3,775,813 | A | * | 12/1973 | Higuchi | A44B 11/2526 24/323 |
| 3,789,492 | A | * | 2/1974 | Klink | 24/639 |
| 4,052,775 | A | * | 10/1977 | Gavagan | A44B 11/2511 200/61.58 B |
| 4,766,654 | A | * | 8/1988 | Sugimoto | 24/637 |
| 4,937,923 | A | | 7/1990 | McEntire | |
| 4,998,328 | A | * | 3/1991 | Tanaka | 24/639 |
| 5,123,147 | A | * | 6/1992 | Blair | A44B 11/2526 24/633 |
| 5,138,751 | A | * | 8/1992 | Shima et al. | 24/637 |
| 5,857,247 | A | * | 1/1999 | Warrick | B64D 17/32 24/603 |
| 6,763,557 | B2 | * | 7/2004 | Steiff | B64D 17/38 24/603 |
| 7,904,997 | B2 | * | 3/2011 | Foubert | A44B 11/2526 24/631 |
| 2007/0130735 | A1 | * | 6/2007 | Diamond | A44B 11/24 24/636 |
| 2007/0226961 | A1 | | 10/2007 | Anderson et al. | |
| 2009/0144896 | A1 | * | 6/2009 | Chen et al. | 5/93.1 |
| 2013/0125355 | A1 | * | 5/2013 | Thorbole et al. | 24/633 |
| 2013/0292990 | A1 | * | 11/2013 | Kohlndorfer | 297/468 |

* cited by examiner

BUCKLE ASSEMBLY

RELATED APPLICATIONS

The present application is a National Phase of International Application Number PCT/US2012/039597, filed May 25, 2012, and claims priority to U.S. Provisional Application No. 61/490,142, filed May 26, 2011.

RELATED APPLICATIONS

This application relates to and claims priority benefits from U.S. Provisional Patent Application No. 61/490,142, entitled "Buckle Assembly," filed May 26, 2011, which is hereby incorporated by reference in its entirety.

FIELD OF THE INVENTION

Embodiments generally relate to buckle assemblies, and more particularly, to durable buckle assemblies that are easy to operate. Embodiments may be particularly suited for buckle assemblies configured for use in military applications, but may be used in various other suitable applications.

BACKGROUND OF THE INVENTION

Traditionally, the military has used certain buckle assemblies that may not be ideal for particular situations. For example, the buckles may be attached to large items that are airdropped during a particular operation. Typical plastic buckles are susceptible to smashing upon impact. Moreover, other types of buckles are susceptible to premature opening.

A known buckle assembly includes a latch pivotally secured to a securing device, which may retain a web, strap, or the like. The latch is configured to be latchably engaged by a frame having a pivotal lever. In operation, the front edge of the latch is slid into the frame, and the lever is manipulated to secure the latch to the frame, which may, in turn, retain a web, strap, or the like.

Typically, the latch has straight edges that are susceptible to snagging. Moreover, the leading edge of the latch is generally straight. Therefore, unless the latch is fully-aligned with the frame prior to mating, a user may find it difficult to quickly and easily guide the latch into the frame.

Additionally, the latch includes an opening configured to retain a portion of the lever therein. However, the diameter and outer perimeter of the opening may typically be larger than the retained portion of the lever. Therefore, when connected, the connection between the lever and the latch may be loose, and produce rattling, shaking, and the like between the latch and the lever.

Further, during a disconnection procedure, an operator may inadvertently over-rotate the lever with respect to the frame. In this manner, the lever and spring member may be damaged. Moreover, even when not being manipulated by an operator, a sudden shock or impact may cause the lever to rotate out of engagement with the latch.

Also, typically, the frame, for example, includes a web or strap opening that generally includes flat edges. It has been found that web or strap material within such a web or strap opening is susceptible to slippage.

Additionally, during operation, debris, dust, or other such material may accumulate within the frame. These materials may hinder proper and secure mating between the latch and the frame. For example, debris may block the latch from securely engaging the frame.

Further, in a known buckle assembly, the lever may secure to the frame through fasteners, such as rivets, pins, or the like. However, the fasteners may include edges that extend past a surface of the frame. As such, the exposed edges of the rivets may snag fabric or potentially cut an operator.

SUMMARY OF THE INVENTION

Certain embodiments provide a buckle assembly that may include a frame having a base connected to opposed side walls. The frame may have a latch chamber between the base and the opposed side walls. The buckle assembly may also include a lever pivotally secured within the latch chamber between the opposed side walls, and a latch configured to be secured in the latch chamber by the lever. The latch may include a frame-engaging member having an ogived leading end. The ogived leading end is configured to self-align the latch within the latch chamber when the latch is mated into the latch chamber.

The ogived leading end may be rounded and smooth. Further, the frame-engaging member may have smooth, curved edges.

The lever may include a locking protuberance, and the latch may include a lever-retaining opening configured to receive and securely retain the locking protuberance within the lever-retaining opening. The lever-retaining opening may be configured to conform to at least one dimension of the locking protuberance to prevent the locking protuberance from rattling, wiggling, or otherwise shifting within the lever-retaining opening.

The frame may include at least one rotation-limiting member extending into the latch chamber. The at least one rotation-limiting member provides a barrier past which the lever is unable to pass. The at least one rotation-limiting member may include at least one semi-spherical protuberance. Alternatively, the at least one rotation-limiting member may include at least one tab.

Each of the opposed side walls may include a fastener-retaining aperture that retains a spring-biased fastener that pivotally secures the lever to the opposed side walls. Each of the fastener-retaining apertures may be surrounded by a recessed fastener head-retaining ledge that receives and retains a head of the spring biased fastener in a flush manner.

The base of the frame may also include a debris-clearing opening configured to prevent debris from settling within the latch chamber. The base may also include at least one waved web channel configured to retain a web or strap.

The frame may also include at least one separating member extending into or from the base.

The lever may include a securing lobe having a latch-engaging protuberance extending therefrom. The latch-engaging protuberance may have a latch-engaging surface area that is smaller than an entirety of the securing lobe. The latch-engaging surface area engages a portion of the latch when the latch is mated into the frame. The only portion of the securing lobe that engages the portion of the latch when the latch is mated into the frame may be the latch-engaging surface. The latch-engaging surface may include a flattened surface extending from the securing lobe through an extension beam. The lever may also include a handle having a smooth, arched opening configured to be engaged by an operator to pivot the lever between closed and open positions in which the latch is secured within the frame and unsecured within the frame, respectively.

Certain embodiments provide a buckle assembly including a frame having a base connected to opposed side walls. The frame may have a latch chamber between the base and the opposed side walls. The buckle assembly may also include a latch configured to be secured in the latch chamber, and a lever pivotally secured within the latch chamber between the opposed side walls. The lever is configured to securely retain the latch within the frame. The lever may include a securing lobe having a latch-engaging protuberance extending therefrom. The latch-engaging protuberance may have a latch-engaging surface area that is smaller than an entirety of the securing lobe. The latch-engaging surface area engages a portion of the latch when the latch is mated into the frame.

The only portion of the securing lobe that engages the portion of the latch when the latch is mated into the frame may be the latch-engaging surface. The latch-engaging surface may include a flattened surface extending from the securing lobe through an extension beam. The lever may include a handle having a smooth, arched opening configured to be engaged by an operator to pivot the lever between open and closed positions.

Certain embodiments provide a buckle assembly including a frame having a base connected to opposed side walls, and at least one separating member extending into or from the base. The frame may include a latch chamber between the base and the opposed side walls, wherein the base includes a debris-clearing opening configured to prevent debris from settling within the latch chamber. The base may also include at least one waved web channel configured to retain a web or strap. The buckle assembly may also include a lever pivotally secured within the latch chamber between the opposed side walls.

The frame may also include at least one rotation-limiting member extending into the latch chamber. The at least one rotation-limiting member provides a barrier past which the lever is unable to pass.

Each of the opposed side walls may include a fastener-retaining aperture that retains a spring-biased fastener that pivotally secures the lever to the opposed side walls. Each of the fastener-retaining apertures may be surrounded by a fastener head-retaining ledge that receives and retains a head of the spring biased fastener in a flush manner.

Figure 1:
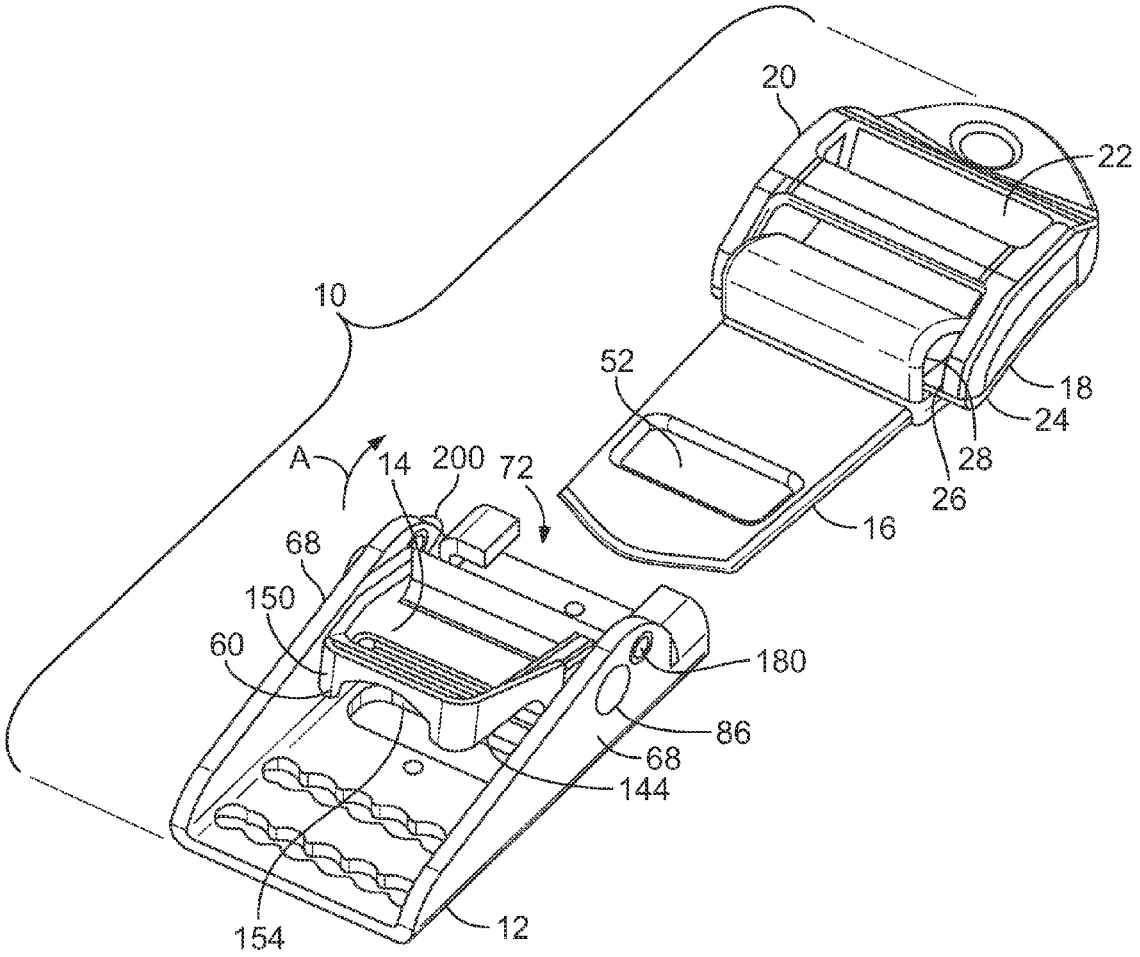
FIG. 1 illustrates a top isometric view of a buckle assembly, according to an embodiment.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE INVENTION

FIG. 1 illustrates an isometric view of a buckle assembly 10, according to an embodiment. The buckle assembly 10 includes a buckle frame 12 having a lever 14 pivotally secured thereto. The buckle frame 12 is configured to selectively connect and disconnect from a latch 16 that may be secured to a securing mount or device 18. The securing device 18 includes a main body 20 having a web passage 22. A distal end 24 of the securing device 18 includes a latch bar 26 that is pivotally secured within a reciprocal channel 28 of the latch 16. Thus, the latch 16 may be rotatably secured to the securing device 18, which, in turn, may be secured to web, strap, or the like.

Figure 2:
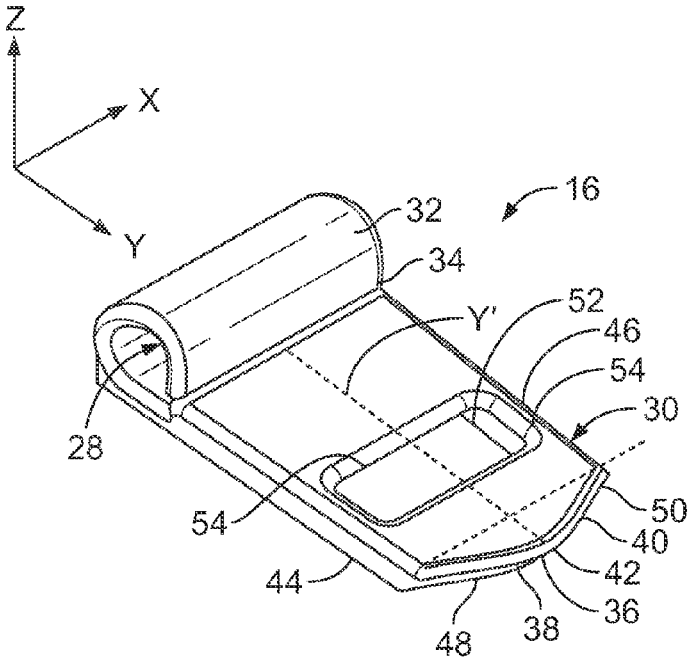
FIG. 2 illustrates a top isometric view of a latch, according to an embodiment.

FIG. 2 illustrates a top isometric view of the latch 16, according to an embodiment. The latch 16 includes a frame-engaging member 30, such as a tongue, panel, tab, planar sheet, or the like. The frame-engaging member 30 may be integrally formed with a bar-retaining member 32 that defines the reciprocal channel 28 into which the latch bar 26 (shown in FIG. 1) of the securing device 18 (shown in FIG. 1) is retained. The bar-retaining member 32 and the frame-engaging member 30 may be formed of a single piece of material, such as plastic or metal. The frame-engaging member 30 is parallel with a plane defined by lateral X and longitudinal Y axes. In order to form the bar-retaining member 32, a terminal end 34 of the bar retaining member 32 may be curved upwardly in the direction of the Z axis, and rolled over so that the terminal end 34 abuts against the planar upper surface of the frame-engaging member 30. In this manner, the reciprocal channel 28 may be formed by the rolled bar-retaining member 32.

Figure 3:
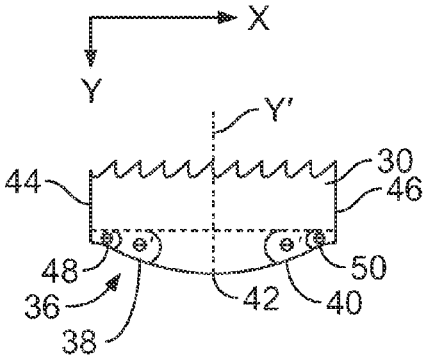
FIG. 3 illustrates a top plan view of a leading end of a frame-engaging member of a latch, according to an embodiment.

FIG. 3 illustrates a top plan view of a leading end 36 of the frame-engaging member 30, according to an embodiment. Referring to FIGS. 2 and 3, the leading end 36 of frame-engaging member 30 is rounded and symmetrical about a longitudinal axis y' of the latch 16. The leading end 36 may be ogived, having a smooth, diagonal arch 38 that connects to an opposite, smooth diagonal arch 40 at a mid-point 42 that lies within the longitudinal axis y'. The arches 38 and 40 may connect to sides 44 and 46, respectively, of the frame-engaging member 30 through rounded, outwardly curved joints 48 and 50. The joints 48 and 50 may also be ogived, but curved at a different angle than the arches 38 and 40. For example, the angle between the joints 48 and 50 and the lateral axis X may be θ, while the angle between the arches 38 and 40 and the lateral axis X may be θ', which may be greater than θ. Alternatively, the arches 38 and 40 may connect directly to the sides 44 and 46, respectively, without the intermediary joints 48 and 50. Overall, the leading end 36 of the frame-engaging member 30 outwardly curves, bows, or the like from the sides 44 and 50 toward the midpoint 42. In this manner, the leading end 36 forms a self-locating lead-in nose that smoothly and easily directs the latch 16 into the frame 12.

Referring again to FIG. 2, a lever-retaining opening 52 is formed through the frame-engaging member 30. The opening 52 is defined by internal, rounded edges 54. Because the edges 54 may be rounded and smooth, the edges 54 are not susceptible to snagging or hooking onto other objects, such as fabric, webs, straps, or the like, as compared to standard, flat-walled edges. The opening 52 may be symmetrical about the axis y', and may be located from the leading end 36 toward a middle of the frame-engaging member 30. However, the opening 52 may be located at any point within the frame-engaging member 30 such that it is configured to engage a feature of the lever 14 (shown in FIG. 1).

The opening 52 is sized to receive and retain a locking protuberance or wall portion 60 (shown in FIG. 1) of the lever 14 so that there is little or no clearance between the outer perimeter of the locking protuberance 60, and the rounded, smooth edges 54 that define the opening 52. Thus, the locking protuberance 60 may be prevented from wiggling, rattling, or the like within the opening 52. For example, the locking protuberance 60 and the opening 52 may form an interference fit when mated together. The inner perimeter of the opening 52 defined by the rounded, smooth edges 54 may conform to the outer perimeter of the locking protuberance 60 of the lever 14, so that the locking protuberance 60 of the lever 14 is securely retained within opening 52.

Figure 4:
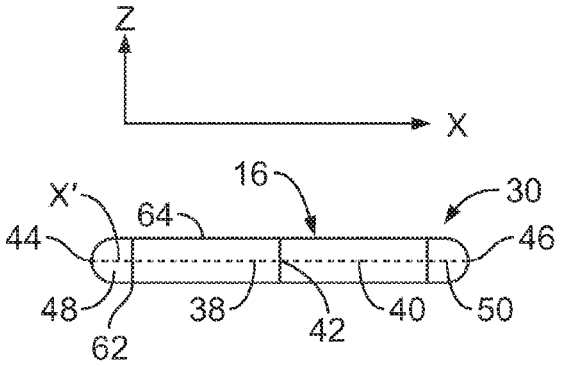
FIG. 4 illustrates an end view of a leading end of a latch, according to an embodiment.

FIG. 4 illustrates an end view of the leading end 36 of the latch 16, according to an embodiment. The outer edges of the sides 44 and 46 may be rounded, tapered, and/or curved. Indeed, the outer (and interior) edges of all portions of the latch 16 may be curved, tapered, and smooth, in contrast to flat walls that connect at right angles to other walls. For example, as shown in FIG. 4, the sides 44 and 46 integrally connect to a base 62 and an upper planar surface 64. Each side 44 and 46 may smoothly outwardly bow, curve, or the like from the base 62 and the upper planar surface 64 to a mid-plane x' of the frame-engaging member 30. The ogived, leading end 36 may also be similarly curved, bowed, or the like. Therefore, the latch 16 may be devoid of any sharp edges, or the like, that may be susceptible to snagging or cutting fabric, such as a web, a strap, or the like. Additionally, the smooth, curved, tapered edges of the latch 16 decrease the likelihood of the latch 16 binding up within the frame 12.

Figure 5:
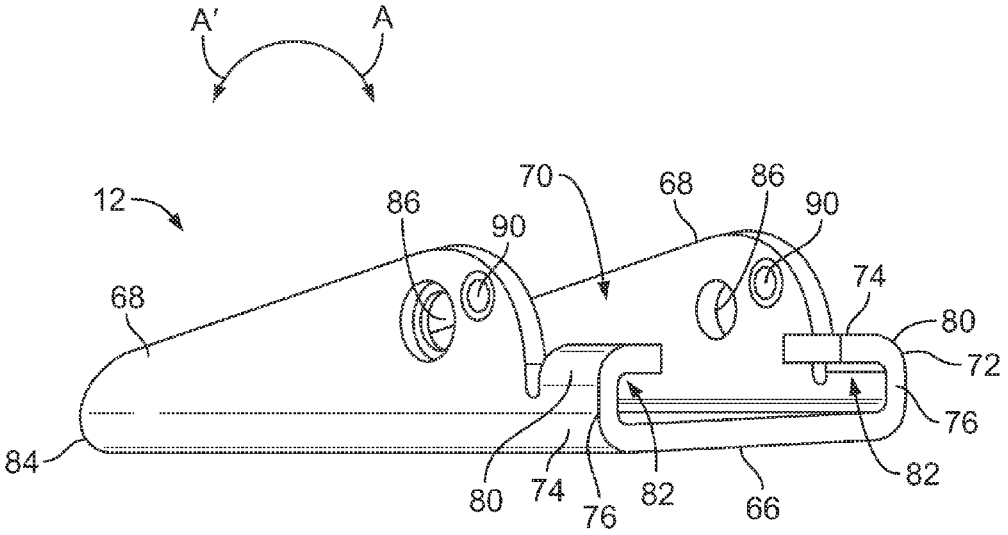
FIG. 5 illustrates a side isometric view of a frame, according to an embodiment.

FIG. 5 illustrates a side isometric view of the frame 12, according to an embodiment. The frame 12 includes a planar base 66 integrally connected to opposed side walls 68, thereby defining a latch chamber 70 therebetween. At a latch-receiving end 72, opposed retaining clips 74 extend upwardly from the base 66. Each retaining clip 74 may include an upstanding wall 76 integrally connected to a covering wall 78, which may be perpendicular to the upstanding wall 76, through a curved intermediate wall 80. A latch-receiving notch 82 is formed between the base 66, the upstanding wall 76, the curved intermediate wall 80, and the covering wall 78. Each latch-receiving notch 82 is configured to receive sides 44 or 46 of the latch 16 (shown in FIGS. 2-4) therein. As explained above, the smooth, curved, ogived leading end 36 of the latch 16 guides the leading end 36 into the latch chamber 70, and automatically aligns the latch 16 therein, so that the sides 44 and 46 are slidably retained within the latch-receiving notches 82. For example, if the latch 16 is misaligned with the latch-receiving end 72 during mating, the tapered side of the ogived leading end 36 forces the latch 16 to slide over the upstanding wall 76 and move inwardly until the upstanding walls 76 abut the sides 44 and 46. The tapered, ogived leading end 36 automatically guides the latch 16 into a proper mating orientation within the frame 12.

As shown in FIG. 5, the side walls 68 of the frame 12 may upwardly ramp from a distal end 84 toward the latch-receiving end 72. Optionally, the side walls 68 may be of uniform height, or may downwardly ramp from the distal end 84 toward the latch-receiving end.

Opposed fastener-retaining apertures 86 are formed through the side walls 68 proximate the latch-receiving end 72. The fastener-retaining apertures 86 are configured to pivotally retain reciprocal pivot fasteners, such as studs, posts, pins, or the like of or operatively connected to the lever 14 (shown in FIG. 1), so that the lever 14 may pivot with respect to the frame in the directions of arcs A and A'. The apertures 86 may be configured to cooperatively receive and rotatably retain a spring-biased pin or other such fastener (not shown in FIG. 5) operatively connected to the lever 14.

Rotation-limiting members, such as protuberances 90, extend from the side walls 68 into the latch chamber 70. Each rotating-limiting protuberance 90 may be a semi-spherical bump or the like, and may be formed by dimpling the outer surface of the side walls 68 into the latch chamber 70. As shown, the protuberances 90 may be positioned between the apertures 86 and the latch-receiving end 72, with the protuberances 90 being positioned at a height above that of the apertures 86. In this manner, the protuberances 90 provide barriers that engage portions of the lever 14. When the portions of the lever 14 engage the protuberances 90, the lever 14 is prevented from further rotation in the direction of arc A.

More or less protuberances 90 may be used than those shown in FIG. 5. For example, only one side wall 68 may include a protuberance 90. Additionally, the protuberances 90 may be located at different levels, depending on the desired arc of rotation of the lever 14 with respect to the frame 12. For example, for increased rotation, the protuberances 90 may be positioned at or below the levels of the apertures 86. For decreased rotation, the height of the protuberances 90 in relation to the apertures 86 may be increased.

Additionally, the protuberances 90 may be various shapes and sizes. For example, the protuberances 90 may be blocks, tabs, flaps, or the like. However, the smooth, rounded, semi-spherical shape of the protuberances 90 as shown in FIG. 5 protects against snagging, cutting, or digging into the outer surface of the lever 14.

Figure 6:
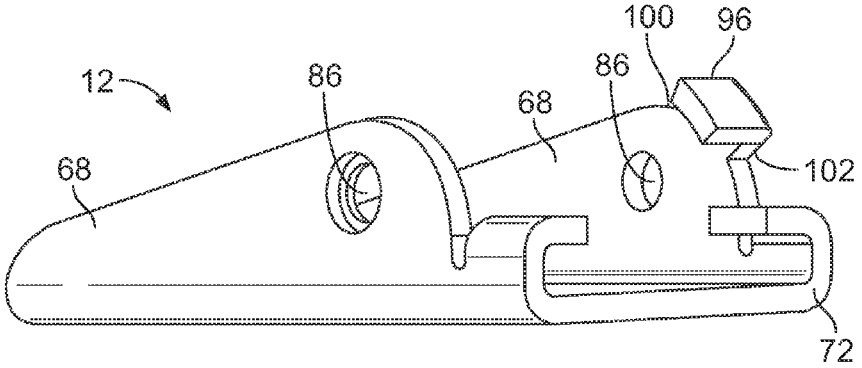
FIG. 6 illustrates a side isometric view of a frame, according to an embodiment.

FIG. 6 illustrates a side isometric view of the frame 12, according to an embodiment. In this embodiment, instead of inwardly-directed protuberances, the rotation-limiting member(s) may include at least one tab 96 extending from a top edge 100 of one or both of the side walls 68 through an extension beam 102, which may connect to the tab 96 at a right angle. The tab 96 may be located between the aperture 86 and the latch-receiving end 72, with the tab 96 extending over a highest portion of the side wall 68. The tab 96 extends inwardly toward a central axis of the frame 12. The tab 96 provides a barrier past which the lever 14 is unable to rotate. If increased lever rotation is desired, the tab 96 may be located more toward the height of the aperture(s) 86. If decreased lever rotation is desired, the tab 96 may be located more toward a position that is directly over the aperture(s) 86. While one tab 96 is shown in FIG. 6, the frame 12 may include opposed tabs located on opposed side walls 68.

Figure 7:
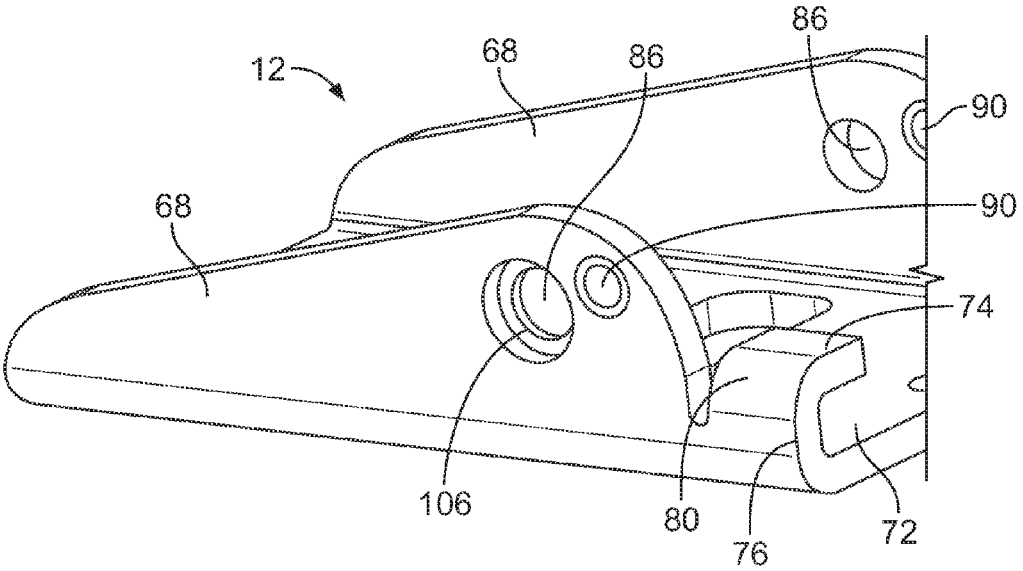
FIG. 7 illustrates an isometric view of side walls of a frame, according to an embodiment.

FIG. 7 illustrates an isometric view of the side walls 68 of the frame 12, according to an embodiment. As noted above, the apertures 86 receive and retain a fastener, such as a stud, post, pin, or the like operatively connected to the lever 14. Outer surfaces of the side walls 68 may include recessed ledges 106 surrounding the apertures 86. The recessed ledges 106 are configured to receive retaining heads of the studs, posts, or the like, so that the studs, posts, pins, or the like do not extend past outer surfaces of the side walls 68. Thus, the retaining heads of the studs, posts, pins, or the like may be countersunk within the side walls 68 of the frame so that they do not snag, hook, or otherwise engage fabric. The retaining heads of the studs, posts, pins, or the like, may be flush with the outer surfaces of the side walls 68 of the frame 12 by virtue of the recessed ledges 106.

Figure 8:
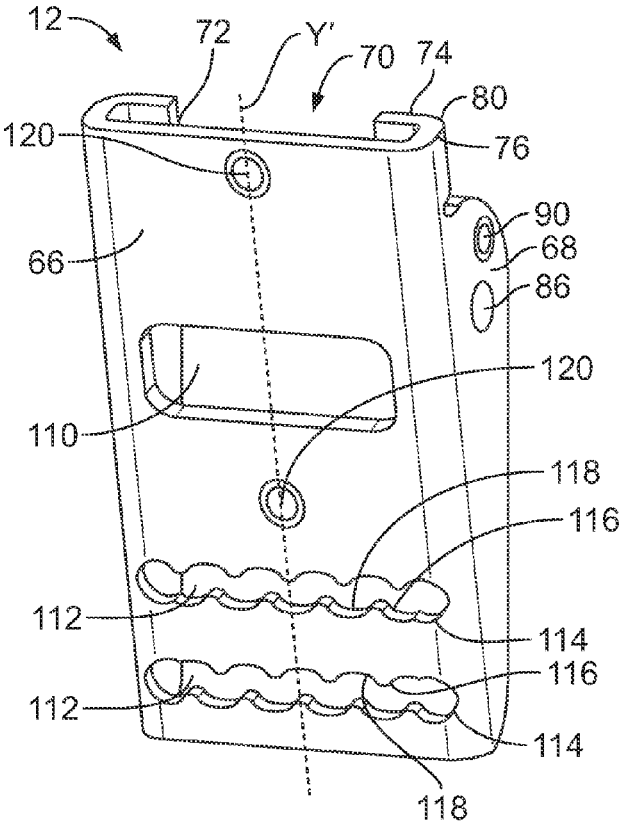
FIG. 8 illustrates a bottom isometric view of a frame, according to an embodiment.

FIG. 8 illustrates a bottom isometric view of the frame 12, according to an embodiment. The frame 12 may include a debris-clearing opening 110, such as a window, cavity, hole, or the like, formed through the base 66. The debris-clearing opening 110 may be located between the latch-receiving end 72 and web channels 112. The debris-clearing opening 110 may span between the opposed side walls 68, or through a smaller distance within the base 66. The debris-clearing opening 110 may be symmetrical about a longitudinal axis y' of the frame 12. The debris-clearing opening 110 may be various shapes and sizes.

In operation, as the leading end 36 of the latch 16 (shown in FIGS. 2-4) is urged into the latch chamber 70, the leading end 36 pushes any debris, such as dirt, dust, stray metal, plastic, or the like, toward the debris-clearing opening 110. As the debris encounters the debris-clearing opening 110, the debris falls out of the frame 12 through the debris-clearing opening 110. Therefore, the latch 16 is able to mate with the frame 12 and the lever 16 without debris hindering the mating process.

As shown, each web channel 112 may be defined by interior edges 114 of the base 66. The interior edges 114 may form alternating peaks 116 and valleys 118, which may be smoothed and rounded, so that the web channels 112 may be wave-shaped, instead of straight. The peaks 116 lock into web or strap material by digging therein. As such, the waved web channels 112 provide a locking interface with the web or strap material that is less likely to allow the web or strap material to slip therethrough, as compared to conventional, straight web channels.

Additionally, the base 66 may include one or more separating members 120. The separating members 120 may be semi-spherical protuberances, dimples, or indentations. It has been found that the separating members 120 prevent the components of the buckle assembly 10 (shown in FIG. 1) from sticking together during manufacturing and coating. Thus, the components of the buckle assembly receive a uniform coating and are aesthetically pleasing due to the separating members 120 preventing the components from sticking together or otherwise interfering with one another during the coating process.

Figure 9:
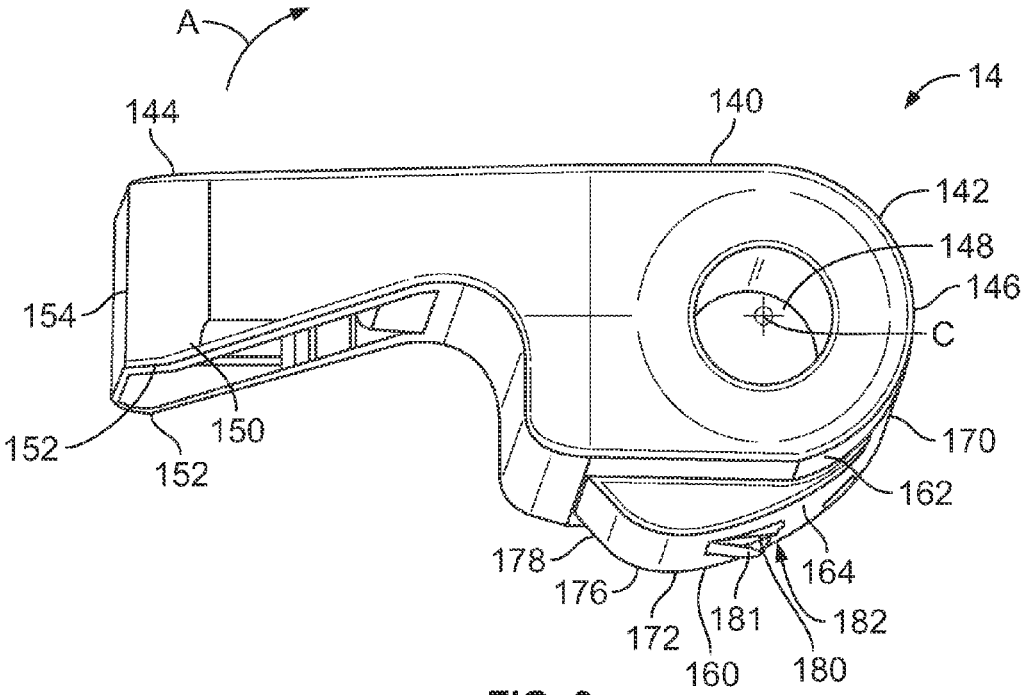
FIG. 9 illustrates an isometric side view of a lever, according to an embodiment.

FIG. 9 illustrates an isometric side view of the lever 14, according to an embodiment. The lever 14 includes a main body 140 having a semi-cylindrical frame-pivot portion 142 integrally connected to a handle 144. The frame pivot portion 142 includes a rounded end 146 having a channel 148 formed therethrough. A central axis c of the channel 148 is perpendicular to the longitudinal axis of the lever 14. The channel 148 is configured to receive and retain a fastener, such as a cylindrical post, pin, stud, or the like, having fastener heads. The fastener is configured to be rotatably secured within the apertures 86 (shown in FIGS. 5-8) so that the lever 14 is pivotally secured to the frame 12, as explained above. The channel 148 may be configured to receive and retain a spring-biased fastener, such as a spring-biased pin (shown in FIG. 10), that secures the lever 14 between the sidewalls 68 of the frame 12.

The handle 144 includes a latch-engaging wall 150 having rounded bottom edges 152 separated by an arched opening 154. The bottom edges 152 may cooperate with one another to form the locking protuberance 60, as shown in FIG. 1. The handle 144 is configured to be engaged by a user in order to connect and disconnect the latch 16 from the frame 12. In operation, the latch 16 is urged into the frame 12, as discussed above. When the lever-retaining opening 52 is under the latch-engaging wall 150, the lever 14 is rotated downwardly, until the bottom edges 152, which may cooperate to define the locking protuberance, are retained within the lever-retaining opening 52. Because the width of the latch-engaging wall 150 may conform to the width of the opening 52, the latch-engaging wall 150 does not rattle or wiggle within the opening 52. The arched opening 154 allows an operator to grasp the latch-engaging wall 150, and pull the lever upwardly in the direction of arc A, in order to disconnect the lever 14 from the latch 16, so that the latch 16 may be removed from the frame 12. Because the surfaces of the latch-engaging wall 150 may be smooth and rounded, an operator is able to comfortably manipulate the lever 14 with his/her fingers.

As shown in FIG. 9, the frame-pivot portion 142 may include a securing lobe 160, such as a ramped member, bulge, bump, or the like, extending downwardly from a lower surface 162. The securing lobe 160 may include a smooth, curved main beam 164 having a height that gradually increases from an end 170 toward an area 172 underneath the channel 148. The main beam 164 may integrally connect to a smooth apex 176, which in turn, may integrally connect to a steep-sloped (in relation to the slope of the main beam 164) end 178 proximate the handle 144.

A smooth, rounded, arced latch-engaging protuberance 180 extends from the securing lobe 160. The width and overall size of the protuberance 180 is substantially less than that of the securing lobe. The protuberance 180 may be centered on the securing lobe 160 and directly underneath the channel 148. The protuberance 180 may include an extension beam 182 that lifts the protuberance away from the securing lobe 160 in a ramped angle or direction that may be opposite the angle of the smooth curved main beam 164. As such, the protuberance 180 prominently extends from the securing lobe 160. The protuberance 180 may include a flattened surface 181 that extends from the securing lobe 160 through a rounded, arced extension beam 182 or stem. The flattened surface 181 is configured to contact the planar surface of the latch 16, instead of the entire surface width area of the securing lobe 160 contacting the planar surface of the latch 16. As such, the force needed to insert the latch 16 into the frame 12 is reduced, due to there being less interfacing, frictional area between the lever 14 and the latch 12.

The protuberance 180 provides an engagement interface with the planar surface of the latch 16 during mating. It has been found that the protuberance 180 allows for a smaller insertion force of the latch 16 into the frame 12 because the planar surface of the latch 16 only exerts force into the protuberance 180, which has less surface area than the entirety of the securing lobe 160, as opposed to the entire surface width of the securing lobe 160.

More or less protuberances 180 may be provided on the securing lobe 160. Again, the protuberance(s) 180 extend from the securing lobe 160 and provide smaller engaging surfaces, as compared to the entire securing lobe 160 itself, that are configured to engage the latch 16. The smaller engaging surfaces of the protuberance(s) 180 allow for easier insertion of the latch 16 between the frame 12 and the lever 14.

Referring again to FIG. 1, the buckle assembly 10 includes the lever 14 retained between the side walls 68 of the frame 12 through an internal spring-biased fastener 180 retained by the opposed apertures 86. In the latched position, the securing lobe 160 (shown in FIG. 9) is retained within the lever-retaining opening 52. The lever 14 may be caused to rotate around the fastener 180 or rotate with the pin upon movement of the lever 14. The spring-biased fastener 180 ensures that the lever 14 remains secured to the latch 16 until such time as the spring force is overcome to allow the separation of the assembly.

In order to unlatch the buckle assembly 10, the handle 144 (see FIG. 9) is urged in the direction of arc A. That is, the lever 14 is rotated against the force exerted by the spring force provided within the lever 14. As the handle 144 rotates in the direction of arc A, the securing lobe 160 is dislodged from the lever-retaining opening 52. Thus, the latch 16 may be removed from the buckle frame 12.

When the handle 144 is disengaged, the force exerted by the spring within the lever 14 returns the lever 14 to the position shown in FIG. 1. The latch 16 may then be mated into the latch-receiving end 72 of the buckle frame 12.

The buckle frame 12, the latch 16, and the lever 14 may be formed of metal, in order to provide strength over plastic alternatives. For example, the buckle assembly 10 may be formed of carbon steel, die cast steel and/or aluminum. Additionally, the buckle assembly 10 may be easily moved between latched and unlatched positions through the lever 14.

Figure 10:
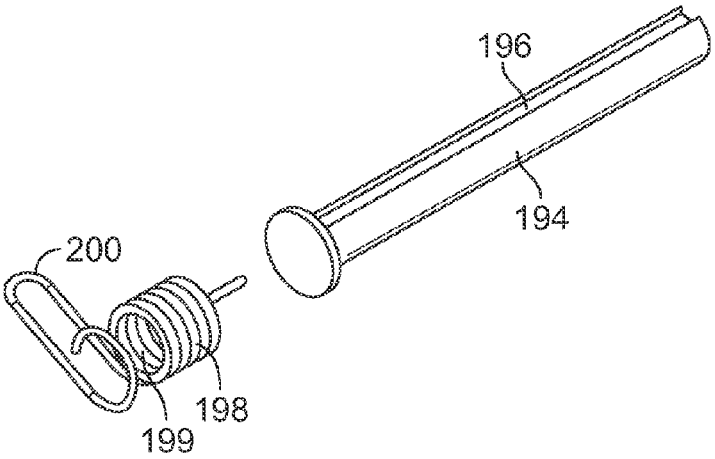
FIG. 10 illustrates an isometric view of a fastener and spring used to secure a lever to a frame, according to an embodiment.

FIG. 10 illustrates an isometric view of a fastener 194 and spring 198 used to secure a lever to a frame, according to an embodiment. Referring to FIGS. 1, 5, 9, and 10, in order to assemble the lever 14 to the buckle frame 12, a portion of the spring 198 may be first placed within the channel 148. Thereafter, the lever 14 and the spring 198 are positioned over the base 66, and between the side walls 68 of the buckle frame 12 so that the channel 148 is aligned with the apertures 86. The fastener 194, such as a pin, may then be passed through an opening 199 in the spring 198, the channel 148, and out the opposite apertures 86, where the fastener 194 may be capped with another retaining head.

The spring 198 may be a coiled spring having an elongated loop 200. The elongated loop 200 includes an end that is configured to hook around the side wall 68 of the buckle frame 12. The spring 198 includes another end that may be placed within the lever 14. The spring 198 may be configured to move about or with the pin 194. The spring 198 is further configured and adapted to engage both the lever 14 and frame 12 to bias the lever 14 in relation to the frame 12. The spring 198 and the pin 194 may cooperate to form a biasing member that spring biases the lever 14, as noted above.

As explained above, embodiments provide a buckle assembly having a latch that allows for single-hand operation. The single-hand operation is facilitated by the tapered front and ogived leading end or nose of the latch, and the arced protuberance (having less surface area than the entirety of the securing globe) extending from the underside of the lever. Additionally, the components of the buckle assembly may be anodized (such as through anodized plating), which provides a smoother finish that reduces friction.

Unlike known buckle assemblies, the embodiments provide a buckle assembly that may be operated with one hand. Additionally, the spring operatively connected to the lever may last much longer because it is prevented from being overstressed (such as due to the rotating limiting member(s)). Further, the rounded edges of the buckle assembly make it safer and more desirable because the chances of cutting or snagging are reduced. Further, the waved channels greatly reduce the likelihood of web slippage.

As mentioned above, the components of the buckle assemblies may be formed of various metals, plastics, and other such materials. Additionally, a hinged cover may be positioned over a portion of the lever to prevent accidental engagement of the lever. Further, while the lever is shown as a separate and distinct component, the lever may alternatively be integrally formed with the buckle frame. Additionally, while the latch is shown and described having a lever-retaining window, and the lever includes a protrusion that is retained within the window, the latch may include the protrusion while the lever may include a window or cavity that retains the protrusion.

Thus, as discussed above, and shown in the figures, embodiments of provide a robust, durable and easy-to-operate buckle assembly.

While various spatial terms, such as upper, lower, mid, lateral, horizontal, vertical, and the like may be used to describe portions of the embodiments discussed above, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

The invention claimed is:

1. A buckle assembly comprising:

a frame having a base connected to opposed side walls, the frame having a latch chamber between the base and the opposed side walls, wherein the frame further comprises at least one rotation-limiting member extending into the latch chamber from at least one of the opposed side walls, wherein the at least one rotation-limiting member comprises at least one semi-spherical protuberance or at least one tab;

a lever pivotally secured within the latch chamber between the opposed side walls, wherein the at least one rotation-limiting member provides a barrier past which the lever is unable to pass;

a latch configured to be secured in the latch chamber by the lever, the latch including a frame-engaging member having an ogived leading end, wherein the ogived leading end is configured to self-align the latch within the latch chamber when the latch is mated into the latch chamber; and wherein each of the opposed side walls comprises a fastener-retaining aperture that retains a spring-biased fastener that pivotally secures the lever to the opposed side walls, and wherein each of the fastener-retaining apertures is surrounded by a fastener head-retaining ledge that receives and retains a head of the spring biased fastener in a flush manner.

2. The buckle assembly of claim 1, wherein the ogived leading end is rounded and smooth.

3. The buckle assembly of claim 1, wherein the frame-engaging member further comprises smooth, curved edges.

4. The buckle assembly of claim 1, wherein the lever comprises a locking protuberance, wherein the latch further comprises a lever-retaining opening configured to receive and securely retain the locking protuberance within the lever-retaining opening, and wherein the lever-retaining opening is configured to conform to at least one dimension of the locking protuberance to prevent the locking protuberance from shifting within the lever-retaining opening.

5. The buckle assembly of claim 1, wherein the base further comprises a debris-clearing opening configured to prevent debris from settling within the latch chamber.

6. The buckle assembly of claim 1, wherein the base further comprises at least one waved web channel configured to retain a web or strap.

7. The buckle assembly of claim 1, wherein the frame further comprises at least one separating member extending into or from the base.

8. The buckle assembly of claim 1, wherein the lever comprises a securing lobe having a latch-engaging protuberance extending therefrom, wherein the latch-engaging protuberance has a latch-engaging surface area that is smaller than an entirety of the securing lobe, and wherein the latch-engaging surface area engages a portion of the latch when the latch is mated into the frame.

9. The buckle assembly of claim 8, wherein the only portion of the securing lobe that engages the portion of the latch when the latch is mated into the frame is the latch-engaging surface.

10. The buckle assembly of claim 8, wherein the latch-engaging surface comprises a flattened surface extending from the securing lobe through an extension beam.

11. The buckle assembly of claim 1, wherein the lever comprises a handle having a smooth, arched opening configured to be engaged by an operator to pivot the lever between open and closed positions.

12. A buckle assembly comprising:

a frame having a base connected to opposed side walls, the frame having a latch chamber between the base and the opposed side walls;

a latch configured to be secured in the latch chamber;

a lever pivotally secured within the latch chamber between the opposed side walls, wherein the lever is configured to securely retain the latch within the frame, wherein the lever comprises a handle having a smooth, arched opening configured to be engaged by an operator to pivot the lever between open and closed positions, and a securing lobe having a latch-engaging protuberance extending therefrom, wherein the latch-engaging protuberance has a latch-engaging surface area that is smaller than an entirety of the securing lobe, and wherein the latch-engaging surface area engages a portion of the latch when the latch is mated into the frame; and wherein each of the opposed side walls comprises a fastener-retaining aperture that retains a spring-biased fastener that pivotally secures the lever to the opposed side walls, and wherein each of the fastener-retaining apertures is surrounded by a fastener head-retaining ledge that receives and retains a head of the spring biased fastener in a flush manner.

13. The buckle assembly of claim 12, wherein the only portion of the securing lobe that engages the portion of the latch when the latch is mated into the frame is the latch-engaging surface.

14. The buckle assembly of claim 12, wherein the latch-engaging surface comprises a flattened surface extending from the securing lobe through an extension beam.

15. A buckle assembly comprising:

a frame having a base connected to opposed side walls, and at least one separating member extending into or from the base, the frame having a latch chamber between the base and the opposed side walls, wherein the base includes a debris-clearing opening configured to prevent debris from settling within the latch chamber, wherein the base further includes at least one waved web channel configured to retain a web or strap; and a lever pivotally secured within the latch chamber between the opposed side walls, wherein the frame further comprises at least one rotation-limiting member extending into the latch chamber, and wherein the at least one rotation-limiting member provides a barrier past which the lever is unable to pass, wherein each of the opposed side walls comprises a fastener-retaining aperture that retains a spring-biased fastener that pivotally secures the lever to the opposed side walls, and wherein each of the fastener-retaining apertures is surrounded by a fastener head-retaining ledge that receives and retains a head of the spring biased fastener in a flush manner.

16. The buckle assembly of claim 15, wherein the at least one rotation-limiting member comprises at least one semi-spherical protuberance.

17. The buckle assembly of claim 15, wherein the at least one rotation-limiting member comprises at least one tab.

* * * * *